United States Patent [19]

Brunes

[11] 4,144,687

[45] Mar. 20, 1979

[54] SELF-SUPPORTING GIRDER STRUCTURE

[76] Inventor: Tons J. Brunes, Attemosvej 8,, 2840 Holte, Denmark

[21] Appl. No.: 560,178

[22] Filed: Mar. 19, 1975

Related U.S. Application Data

[63] Continuation of Ser. No. 376,128, Jul. 3, 1973, abandoned, which is a continuation-in-part of Ser. No. 157,381, Jun. 28, 1971, abandoned.

[30] Foreign Application Priority Data

Jul. 1, 1970 [DK] Denmark ..... 3438/70

[51] Int. Cl.[2] ..... E04C 3/10

[52] U.S. Cl. ..... 52/229; 52/31; 52/173 R; 52/227; 52/309.16; 198/860

[58] Field of Search ..... 198/204, 184, 860; 206/322; 14/17, 3, 4, 13; 52/173, 227, 228, 433, 229, 723, 31, 309.16

[56] References Cited

U.S. PATENT DOCUMENTS

| | | | |
|---|---|---|---|
| 1,385,606 | 7/1921 | Christensen | 52/227 |
| 1,579,285 | 4/1926 | Danaher et al. | 52/227 X |
| 2,075,633 | 3/1937 | Anderegg | 52/229 |
| 2,645,115 | 7/1953 | Abeles | 52/229 |
| 2,874,812 | 2/1959 | Clevett, Jr. | 52/227 |
| 3,253,416 | 5/1966 | Madison | 198/204 X |
| 3,260,025 | 7/1966 | Van Der Lely | 52/228 |
| 3,372,518 | 3/1968 | Rensch | 52/227 |
| 3,472,031 | 10/1969 | Kelso | 52/227 |
| 3,478,865 | 11/1969 | Vogel | 198/204 |

FOREIGN PATENT DOCUMENTS

| | | | |
|---|---|---|---|
| 665574 | 9/1938 | Fed. Rep. of Germany | 206/322 |
| 815836 | 10/1951 | Fed. Rep. of Germany | 52/227 |
| 955395 | 1/1957 | Fed. Rep. of Germany | 198/204 |
| 54319 | 3/1948 | France | 52/433 |
| 1008388 | 2/1952 | France | 52/433 |
| 440184 | 10/1948 | Italy | 52/433 |

*Primary Examiner*—Alfred C. Perham
*Attorney, Agent, or Firm*—Walter Becker

[57] ABSTRACT

A self-supporting girder structure which comprises a plurality of sections of rigid material having a triangular cross section while means are provided for preventing the sections from a mutual lateral displacement, means being provided which extend through holes in all of the sections in the longitudinal direction of the structure for holding the sections together.

1 Claim, 12 Drawing Figures

Figure 1:
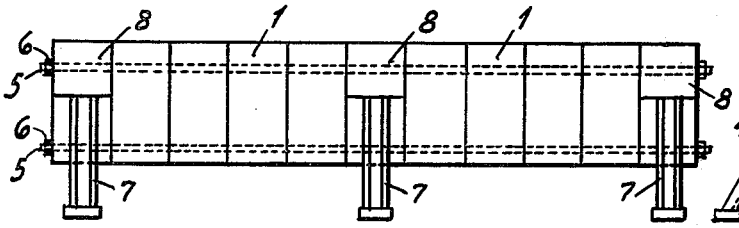

INVENTOR.
Tons Jean Brunés
BY
Walter Becker

SELF-SUPPORTING GIRDER STRUCTURE

This is a continuation of application Ser. No. 376,128, filed July 3, 1973 now abandoned, which is a continuation-in-part of Ser. No. 157,381 filed June 28, 1971 now abandoned.

Self-supporting girder structures are generally formed as lattice girders of either wood or steel, in which large longitudinal beams and possibly short compression-reducing or stress-reducing struts or ties are incorporated.

If a mountable supporting structure has to be erected, the transport of the long spans is generally very complicated and often costly. In certain cases the previous erection of a supporting structure is made in a workshop. The structure is then partly taken apart for transportation of the structure parts to the final place of assembly, where the parts are again assembled. This separation is necessary in order that the smaller parts can be transported by ordinary transport means such as ship, railway or lorry, but such a transport always contains a risk of damage or undesired deformation of the structure parts rendering the final erection difficult.

Even a simple structure part such as a girder can be difficult to transport to the place of assembly.

One feature of the present invention is to provide a self-supporting girder structure, that is cheap to make, easy to assemble and to erect and if desired, easy to take apart again, to transport and to erect at another place, and which can be done without skilled workers and without the use of special tools.

The self-supporting girder structure according to the invention is characterised in that it comprises a plurality of identical elements, formed by a rigid material in a hollow prismatic configuration having a triangular cross section, said elements being provided with means, which can prevent the elements from mutual lateral displacement, and the means for holding together the elements are assembling devices led through channels provided at the three corners of each element.

The sections can be made of any suitable material, for instance metal, preferably light-alloy metal, but also wood, including for instance laminated wood. However, plastics are preferably used.

A self-supporting girder structure as described above, assembled in sections having a triangular cross-section and being kept together in spans by means of assembling devices led through holes in the sections, may easily be taken apart by removing the assembling devices whereupon the sections may be linked lying side by side, so as to build a polygon, which is then kept together by means of straps strapped round all the sections of the polygon. More polygons of sections kept together in that way may be linked side by side and then kept together by means of assembling devices led through some of the holes in the sections the purpose of which is to receive the previously mentioned assembling devices, which are intended for keeping together the individual girders of the supporting structure. In this way a long girder of a supporting structure may be reduced to a length which may without difficulty be forwarded by ship, railway or lorry from the place of production to a place of assembly and again from such place of assembly to another place of assembly. This may often occur within the building industry, for instance when building new houses or industrial plants, as a temporary supporting structure must after the finishing of a building or an industrial plant be removed and moved to another place in connection with the erection of new buildings or industrial plants.

When the sections so kept together by straps arrive at a place of assembly the straps are removed from the sections, and the sections are placed in a rank and clamped together to a girder by means of the clamping devices which are led through the holes in the sections intended therefore.

It is previously known to make building parts, such as beams, rafters, columns, walls, floors and roofs, even furniture, of pre-fabricated parts which are then kept together by assembling devices led through the parts. But none of these structures are composed of triangular sections such as is the case with the self-supporting girder structure according to the present invention. The means for prevention of a mutual lateral displacement of the triangular sections of the structure may consist of protuberances and the grooves elaborated in the surfaces of the structure facing each other, which may for instance be extending along the one or all three sides of the section. Instead of providing the sections with tongues and grooves one of the surfaces may have at least two protruding pins and the other surface two correspondingly adjusted recesses for the reception of the pins.

The assembling devices led through the holes in the sections generally consist of metal bars or metal ropes, preferably of steel, with attendant clamping devices, such as threaded pins and matching nuts. These clamping devices may according to the invention give a prestressing to the supporting structure. This is particularly necessary in case of relatively long span structures. When such structures have not been pre-stressed the elasticity of the clamping devices causes that wedge-shaped gaps occur between the sections from the undersides of same when loading the structure.

Furthermore wedge-shaped distance pieces may according to the invention appropriately be inserted between the sections in defined lengths of the structure or in the whole length of same. Hereby the structure may be given a curve in horizontal or vertical direction or alternately in one direction or the other. This may be appropriate if the structure shall be able to pass stationary obstacles to its straight course.

The self-supporting girder structure according to the invention can be placed as a girder either with one of the angle edges of the sections directed upward or with one of the sides directed upward.

In the first-mentioned case there may furthermore according to the invention on some of the sections at each side of the upward directed triangular point be located supporting sections having a triangular cross-section and designed such that they can form a supporting surface for, for instance, bearing frames with shafts and chain wheels for endless chain conveyors or shafts and rollers for an endless conveyor belt. These supporting sections may be fastened by means of screw bolts, so that they can be released from the self-supporting structure during transport or moving. These supporting sections may after having been released from the self-supporting structure be lined up side by side so as to form a polygon, which is then held together by means of straps, which strap around all the sections of the polygon in the same way as is the case with regard to the triangular sections of the self-supporting structure.

The self-supporting girder structure according to the invention can be used within a number of different fields both as permanent and as temporary structures.

The self-supporting girder structure according to the invention may for instance be used as supporting girders in roof constructions of flat and slightly tilting roofs reaching from bearing wall to bearing wall and bearing the roof covering proper.

In the case of sloping roofs it may be used as continuous girder in the roof ridge stretching from gable to gable and possibly supported by intermediary cross-walls, however, also as rafters.

It may also be used in bridge structures, for instance permanent or temporary gangways, either with the sections lying in one or more rows side by side with the triangular sides turning upward, or for instance with two rows of sections each with the points turning upward and supporting cross-planks forming the bridge layer proper, or composed of several rows of sections, alternately with the points facing upward or downward.

Furthermore, they can be used as supporting sections for tubes or pipes.

A special field of application is as a supporting structure for conveyors.

If the supporting structure has to be placed on a firm base, for instance the ground, it may be provided with removable legs, which are fastened by means of screw bolts, and the legs may be adapted in number to the length of the structure and may be designed so as to be suitable for the available base.

It is certain that a supporting structure consisting of a number of uniform single parts which can be lined up and clamped together and, if desired, again taken apart, so that they may easily and cheaply be transported in a compact form, easily be moved from one place of assembly to another place of assembly, and erected without skilled workers and special tools, must give a considerable financial gain in relation to what is hitherto known within this technical field.

Figure 2:
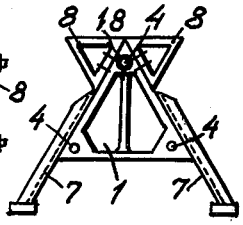
Figure 3:
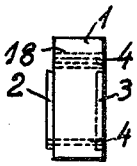
Figure 4:
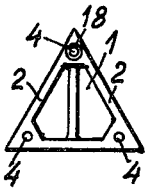
Figure 5:
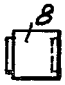
Figure 6:
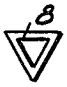
Figure 7:
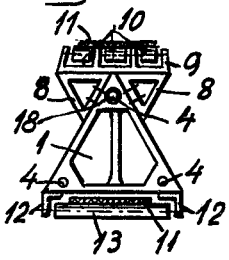
Figure 8:
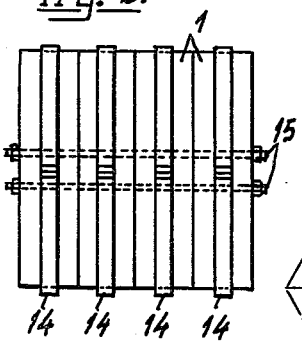
Figure 9:
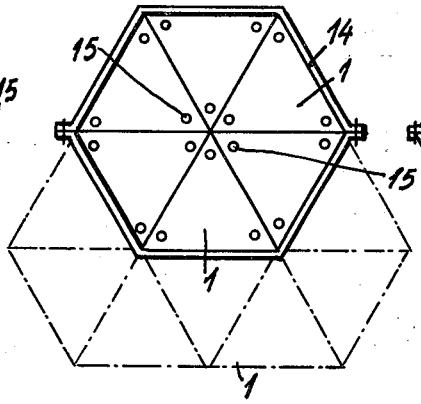
Figure 10:
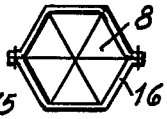
Figure 11:
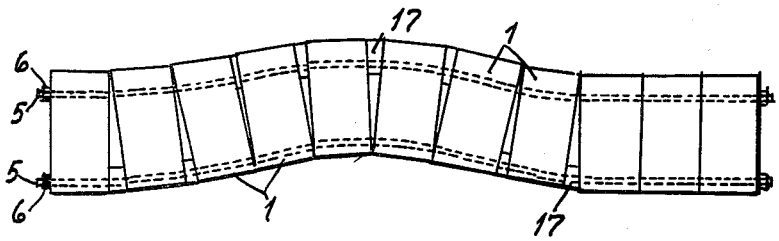
Figure 12:
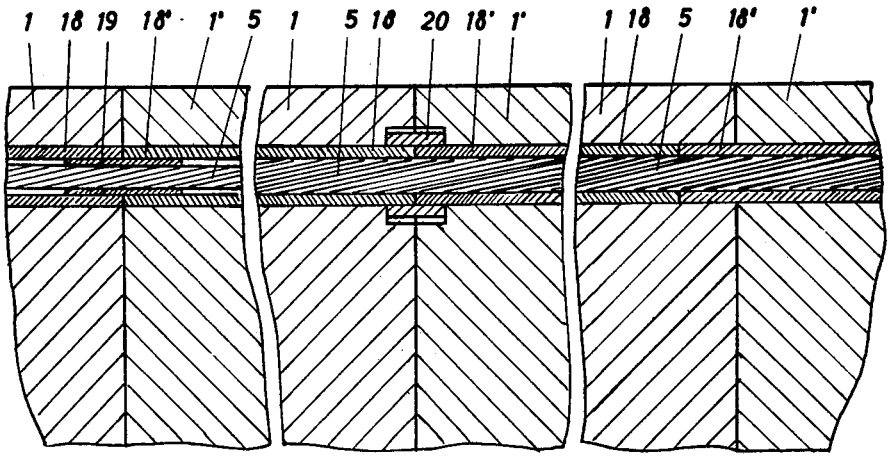

The self-supporting girder structure according to the invention is further described in the following by means of embodiments, where the self-supporting girder structure is used as a supporting structure for a band conveyor, and is illustrated in the drawing, wherein FIG. 1 shows the structure in side elevation, FIG. 2 the same as viewed from one of its ends, FIG. 3 shows one of the sections of the structure in side elevation, FIG. 4 the same as viewed from one of its ends, FIG. 5 shows a supporting section for location on the sections of the structure in side elevation, FIG. 6 the same as viewed from one of its ends, FIG. 7 shows one of the sections of the structure with mounted bearing frame with rollers and shafts for a conveyor belt as viewed from one of its sides, FIGS. 8 and 9 show the combination of a number of the sections of the structure for transport as viewed in side elevation respectively from one of its ends, FIG. 10 shows the combination of a number of supporting sections for transport as viewed from one of its ends, and FIG. 11 shows the girder of the supporting structure in a deflected embodiment in side elevation, and FIG. 12 shows examples of guiding the bushes.

The supporting structure must have a particular length according to its use and must have dimensions according to the burden it has to carry. The structure is composed of a number of sections 1 of rigid plastics with a triangular cross-section which may be either equilateral or isosceles. To prevent a mutually lateral displacement of the sections, they have in the surfaces facing each other tongues and grooves 2 respectively 3 adapted to each other, and preferably located at the outer edge of the section and extending over a part of or over the whole circumference of the section and so that there are at one end of the section tongues and at the other end of the section grooves, see FIG. 3. The tongues and grooves need not be located at the outer edge of the section, but may be located a little from the edge of the surface or the surfaces, but they must under all circumstances taken together have some not straight or polygonal shape or other, to be able to secure the sections against a mutually lateral displacement. Instead of tongues and grooves at least two pins in one of the surfaces of the sections facing each other and matching recesses in the other may be used. Such pins and recesses are not shown in the drawing. To keep the sections 1 together in a line, assembling devices 5, preferably comprising metal (e.g. steel) ropes, are led through holes 4 in the sections, but the assembling devices may under certain circumstances consist of rigid metal (e.g. steel) bars, for instance when the structure must be straight. These ropes or bars have end clamping devices 6 of some known structure or other. The sections 1 are kept together by means of the assembling devices 5 so that they form a girder. The assembling devices 5 give the structure a prestress in order to prevent, thereby, an extension of the devices on account of their elasticity when the structure is loaded, and to prevent the formation of gaps between the sections at the undersides of same. Generally the structure need not be supported in its whole length. As shown in FIGS. 1 and 2 in the drawing the structure may, therefore, be provided with legs 7, which may be fastened to the sides of some of the sections 1 by means of screw bolts. The girder may be made to carry conveyors of various kinds, for instance chain conveyors with endless chains located on rotable chain wheels in connection with a driving machinery, or a band conveyor with an endless conveyor belt located round rotatable rollers in connection with a driving machinery. The driving machinery may be of the known kind and is, therefore, not shown in the drawing. The conveyor shown in the drawing is a band conveyor. To carry the bearing rollers of the conveyor there are on some of the sections 1 of the structure located supporting members 8, which by means of screw bolts are fastened to the one respectively the other side of the upper part of the sections 1. The members 8 have a triangular cross-section corresponding to the cross-section of the sections 1, but are of a considerably smaller size. On the members 8 there are, for instance by means of screw bolts, located bearing frames 9, with shafts with bearing rollers 10, for the support of the upper part of an endless conveyor belt 11, and on the under side of some of the sections 1 there are, for instance by means of screw bolts located bearing frames 12 to carry a shaft with idlers 13 to support the lower part of the conveyor belt 11. These bearing frames with bearing blocks with shafts and rollers are shown in FIG. 7 in the drawing. When the structure has to be transported or to be moved from one place to another, the legs 7, the members 8, the bearing frames 9 with supporting rollers 10 and the bearing blocks 12 with shafts with supporting rollers 13 and the conveyor belt 11 are taken apart from the sections 1 of the structure which are, thereafter, by removal of the assembling devices 5 taken apart from each other and brought together in a number of six as shown in FIG. 9 in the drawing, and then clamped together by means of a clamp 14. More than six sections 1 may be lined up. In FIG. 9 is shown by means of dotted lines how a further seven sections 1 may be added. The clamp must be enlarged accordingly. More such assemblies of sections 1, which are shown in FIG. 9, may be lined up and kept together by means of assembling devices, for instance rigid bars 15, as shown in FIG. 8. In this manner a long supporting structure may be brought down to such a short length that it may without difficulty be transported by ship, railway or lorry. The members 8 may be put together and clamped by means of clamps 16 in the same manner as is mentioned above as far as the sections 1 are concerned, which is shown in FIG. 10 in the drawing.

There may be cases where it is appropriate that the structure be curved, either horizontally or vertically. Such a curving of the structure may be provided by one-sidedly in the structure placing and fastening wedge-shaped separators 17 at shorter or longer stretches between the sections 1, as shown in FIG. 11 in the drawing. By such an embodiment of the structure the assembling devices 5 must be flexible metal (e.g. steel) ropes. Such separators 17 may easily be removed from the structure when same has to be moved from place to place.

For the absorption of compressive stresses at the upward turning point of the triangular members in case the plastics used cannot resist the stresses occurring, the point of the member may be provided with a device of metal. For instance there may in the hole 4 be inserted a bush 18 of metal, preferably steel, which can absorb the occurring compressive stresses, such as shown in the FIGS. 3 and 4 in the drawing.

In order to prevent these bushes 18 from getting displaced in relation to each other various measures may according to the invention be adopted. Three examples of guiding the bushes are shown in FIG. 12. Two sections 1 and 1' of a supporting structure are shown to the left. Through each section bushes 18, 18' respectively are inserted, and inside at the ends of these a guide bush 19 is located through which a steel rope 5 is drawn, strapping together all sections of the supporting structure. In the same way in the middle of FIG. 12 an outer guide bush 20 is shown the inside diameter of which corresponds to the outside diameter of the bushes 18 and 18', recesses for receiving the bush 20 being placed in the end surfaces of the sections. Finally, it is shown to the right on FIG. 12 how the bushes 18 and 18' are displaced so that they extend into the hole of an adjacent section, said hole intended for the assembling devices.

What I claim is:

1. In combination with self-supporting linear girder structure made up of a plurality of identical, triangular, separable sections of molded plastic arranged linearly, each section having an equilateral triangular cross section transverse to said linear structure, the adjoining faces of said sections having complementary interengaging projections and recesses to prevent relative transverse movement, longitudinal openings through each section adjacent the apices of the triangular section, a metal tubular bush through each opening, so that said bushes when assembled form longitudinal passages through said girder structure, the bushes in each section being equally spaced at the apices of the triangular section and having the exact length of a section with their ends flush with the end faces of the sections, longitudinal tensioning members extending through said passages from end to end, and clamping means on the ends of said tensioning members to clamp said sections together, said clamping means placing said longitudinal members under tension and prestressing said sections, said bushes engaging to limit compression of said sections, and a pair of triangular members each having the cross section of an equilateral triangle secured to the top apices of certain sections so that one face of each of two triangular members abuts opposite faces at the top of a section to form a flat support composed of two faces of the triangular members and a conveyor supported by said structure on said two faces which form a plane parallel to the section face opposite to the top of the section.

* * * * *